US006800998B2

(12) United States Patent
De Maagt

(10) Patent No.: US 6,800,998 B2
(45) Date of Patent: Oct. 5, 2004

(54) DISCHARGE LAMP PROVIDED WITH A GETTER

(75) Inventor: Bennie Josephus De Maagt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 73 days.

(21) Appl. No.: 10/135,343

(22) Filed: Apr. 30, 2002

(65) Prior Publication Data

US 2002/0190644 A1 Dec. 19, 2002

(30) Foreign Application Priority Data

May 1, 2001 (EP) ..... 01201576

(51) Int. Cl.[7] ..... H01J 61/18; H01J 61/34; H01J 17/24

(52) U.S. Cl. ..... 313/638; 313/25; 313/553

(58) Field of Search ..... 313/553, 559, 313/637, 638, 640, 25, 17, 568, 572, 641, 642

(56) References Cited

U.S. PATENT DOCUMENTS

| | | | | |
|---|---|---|---|---|
| 4,025,812 A | | 5/1977 | McVey | 313/176 |
| 4,203,049 A | | 5/1980 | Kuus | 313/174 |
| 4,808,876 A | * | 2/1989 | French et al. | 313/25 |
| 4,918,352 A | * | 4/1990 | Hess et al. | 313/25 |
| 5,961,750 A | * | 10/1999 | Boffito et al. | 148/442 |

FOREIGN PATENT DOCUMENTS

| | | | |
|---|---|---|---|
| EP | 0869195 A1 | 7/1998 | C22C/16/00 |
| GB | 2154054 A | 8/1995 | H01K/1/54 |
| WO | WO9843269 | 1/1998 | H01J/9/14 |
| WO | WO0200959 | 3/2000 | C23C/14/34 |
| WO | WO0061832 | 10/2000 | C23C/14/56 |
| WO | WO0075950 | 12/2000 | H01J/7/18 |
| WO | wo0192590 | 6/2001 | C22C/16/00 |
| WO | WO0227058 | 4/2002 | C23C/14/16 |

OTHER PUBLICATIONS

Database WPI, Section Ch, Week 197741 Derwent Publiations Ltd., London, GB; XP002221185 & JP52103879A, Aug. 31, 1977.

Patent Abstracts of Japan, Kono Satoru, "Metal Halide Lamp," Publication No. 54031979, Mar. 9, 1979, Application No. 52098073, Aug. 16, 1977.

Patent Abstracts of Japan, Ishibashi Koichi, "Both–Base Type High Pressure Sodium Lamp," Publication No. 04233153, Aug. 21, 1992, Application No. 02409052, Dec. 28, 1990.

* cited by examiner

*Primary Examiner*—Vip Patel
*Assistant Examiner*—Karabi Guharay
(74) *Attorney, Agent, or Firm*—Ernestine C. Bartlett

(57) ABSTRACT

In a discharge lamp comprising a discharge vessel surrounded by an outer bulb filled with nitrogen, a hydrogen getter is used comprising more than 80% by weight of Zr and Co and one or more elements chosen from the rare earth elements. The getter effectively removes hydrogen from the outer bulb and is not poisoned by nitrogen.

4 Claims, 1 Drawing Sheet

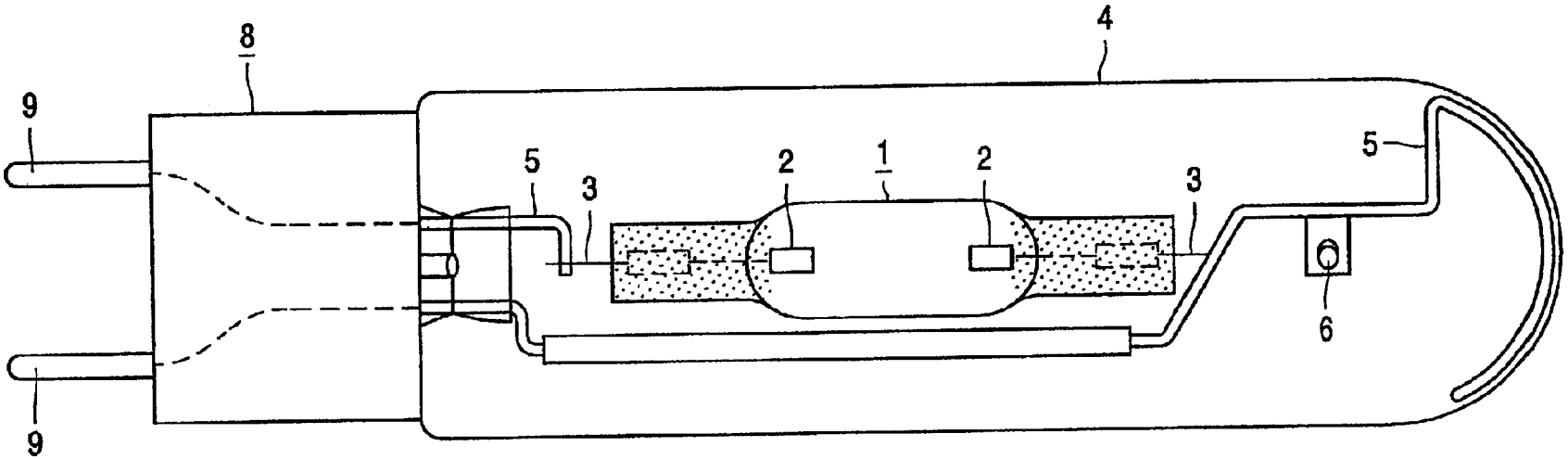
5
6
3
4
2
1
2
3
5
8
9
9

DISCHARGE LAMP PROVIDED WITH A GETTER

The invention concerns a discharge lamp, provided with a discharge vessel surrounded, at some distance, by an outer bulb filled with gas and provided with a getter.

Such a discharge lamp is known. An example of such a discharge lamp is a metal halide lamp. In such a known discharge lamp, the outer bulb is often filled with nitrogen, the pressure of which at room temperature is selected to be in the range 250 mbar–600 mbar. The getter is present in the lamp in order to remove hydrogen that comes to be in the outer bulb during lamp manufacture. If this hydrogen is not removed from the outer bulb, this hydrogen also enters the discharge vessel by diffusion through the discharge vessel wall. In this case re-ignition of the discharge lamp will be problematic. In practice it is difficult to find a getter with which in a nitrogen atmosphere small quantities of hydrogen can be removed for the greater part from the outer bulb. The getter must meet the requirement that hydrogen is effectively removed while the getter at the same time must not become poisoned by the nitrogen. The latter requirement often has the consequence that the getter cannot be activated by heating the getter for a certain time at a relatively high temperature. Such activation would increase the "getter activity" for gettering nitrogen to such extent that the getter would become poisoned by nitrogen.

It is an object of the invention to provide a discharge lamp provided with an outer bulb filled with gas and provided with a getter, in which hydrogen is removed in an effective manner from the outer bulb by the getter.

To achieve this a discharge lamp as mentioned in the opening is characterized in accordance with the invention in that the getter comprises more than 80% by weight Zr and Co and moreover one or more elements are chosen from among the rare earth elements.

It has been found that in a discharge lamp in accordance with the invention hydrogen is effectively removed from the outer bulb of the discharge lamp. It was found to be unnecessary to activate the getter, and the getter did not become so poisoned by other gases present in the outer bulb that the hydrogen gettering activity dropped significantly.

In a preferred embodiment of a discharge lamp in accordance with the invention, the gas composition contains nitrogen. It has been found that the getter that is used in the outer bulb of a discharge lamp in accordance with the invention is able to effectively getter hydrogen without becoming saturated with nitrogen and without it being necessary to activate the getter.

Good results have been obtained for embodiments of a discharge lamp in accordance with the invention in which the rare earth metals present in the getter are chosen from the group comprising Ce, La and Nd.

Good results have likewise been obtained for embodiments of a discharge lamp in accordance with the invention in which the percentage by weight of Zr in the getter is selected to be between 75% and 85%, the percentage by weight of Co in the getter between 10% and 20% and the percentage by weight of the rare earth metals between 1% and 10%. Discharge lamps in accordance with the invention with which good results have been obtained are metal halide lamps. It has been found that the quantity of hydrogen in the outer bulb of these lamps after a relatively low number of burning hours has fallen to virtually nil.

An example of the invention will be explained in more detail with reference to a drawing.

In the drawing, an example of a discharge lamp in accordance with the invention is shown.

In the FIGURE, there are contacts 9 for securing the discharge lamp to a power supply. The contacts 9 are secured to a lamp base 8. At the lamp base 8, an outer bulb 4 formed from hard glass is secured that surrounds a gas-tight area filled with nitrogen. The filling pressure of the nitrogen at room temperature is approximately 500 mbar. In this area a discharge vessel 1 is present that is formed from quartz glass and is secured to supply conductors 5. At one of the supply conductors 5, also a getter 6 is secured. The getter 6 is manufactured by SAES, is referred to as St 787/DF25 and comprises approximately 80% by weight Zr, 15% by weight Co and 5% by weight a mixture of rare earths elements comprising La, Nd and Ce. The discharge lamp is a metal halide lamp and the discharge vessel comprises 60 mbar Ar and a mixture of metal iodides. Reference numeral 2 refers to electrodes of the discharge lamp that are connected via current supply conductors 3 with the supply conductors 5. For a discharge lamp as shown in the FIGURE, it has been found that the quantity of hydrogen present in the outer bulb after 100 hours of burning and after 200 hours of burning is less than 0.001 mol %.

Table 1 shows the results of an experiment in which the nitrogen-sensitivities of both the St 787/DF25 getter and the PH/DF50 getter from SAES are evaluated. The getter PH/DF50 is a getter that is often used in discharge lamps with an outer bulb filled with nitrogen. The getter PH/DF50 comprises 70% by weight $Zr_2Ni$, 20% by weight Ni and 10% by weight W. Each of the getters was placed in a nitrogen atmosphere of 1000 mbar at a temperature of 500° C. for varying time intervals. Then the activity for hydrogen absorption was measured in an argon flow comprising 1 mol % hydrogen. The table shows the maximum hydrogen getter speed $J_{max}$ of the two getters after 0, 1, 19, 70 and 384 hours contact with nitrogen at 500° C. The table also shows how long it took before this maximum getter speed was reached: $time_{max}$, as well as the value Q of the capacity of the getter. It can be seen that the maximum hydrogen getter speed of St787/DF25 is in all cases higher than that of PH/DF50. Furthermore, it can be seen that after a relatively long exposure to the nitrogen atmosphere this maximum getter speed is reached considerably more quickly by the St787/Df25 getter than by the PH/DF50 getter. Finally, it can be seen that the capacity of the getter for hydrogen after all the measured time intervals in which the getter was in contact with a nitrogen atmosphere of 500° C., is considerably higher in the case of St787/DF25 than in the case of PH/DF50. The data in Table I therefore clearly show that St787/Df25 is a more effective hydrogen getter in a nitrogen atmosphere than PH/DF50.

TABLE 1

| Time (h) | $J_{max}$(mbar · ml/min.mg) | | $time_{max}$(min) | | Q(mbar · ml/mg) | |
|---|---|---|---|---|---|---|
| in N2 | St787 | PH/DF | St787 | PH/DF | St787 | PH/DF |
| 0 | 5.60 | 5.20 | 4 | 3 | 149.7 | 82.1 |
| 1 | 5.53 | 4.87 | 6 | 6 | 151.5 | 84.3 |
| 19 | 5.12 | 1.61 | 12 | 60 | 133.4 | 76.9 |
| 70 | 4.70 | 1.96 | 22 | 62 | 120.7 | 68.7 |
| 384 | 3.94 | 1.96 | 29 | 76 | 119.2 | 71.7 |

What is claimed is:

1. A discharge lamp, comprising:

a discharge vessel, wherein the discharge vessel comprises Ar and a mixture of metal iodides at a pressure of 60 mbar;

an outer bulb filled with gas containing nitrogen, wherein the discharge vessel is surrounded, at a distance, by the outer bulb filled with gas; and a non-activated getter disposed within the outer bulb, wherein the getter comprises more than 80 percent by weight Zr and Co and furthermore comprises one or more elements chosen from among rare earth metals, wherein the non-activated getter is configured to remove hydrogen present in the outer bulb to a quantity of less than 0.001 molecular percent of hydrogen in the gas of the outer bulb after 100–200 hours of burning and without the non-activated getter becoming poisoned by the nitrogen.

2. The discharge lamp as claimed in claim 1, wherein the rare earth metals in the getter are chosen from the group comprising Ce, La and Nd.

3. The discharge lamp as claimed in claim 1, wherein the percentage by weight of Zr in the getter is selected to be between 75% and 85%, the percentage by weight of Co in the getter is selected to be between 10% and 20% and the percentage by weight of the rare earth metals in the getter is selected to be between 1% and 10%.

4. The discharge lamp as claimed in claim 1, wherein the discharge lamp is a metal halide lamp.

* * * * *

UNITED STATES PATENT AND TRADEMARK OFFICE

CERTIFICATE OF CORRECTION

PATENT NO. : 6,800,998 B2
APPLICATION NO. : 10/135343
DATED : October 5, 2004
INVENTOR(S) : De Maagt It is certified that error appears in the above-identified patent and that said Letters Patent is hereby corrected as shown below:

On the first page the name of the assignee should appear as follows:

(73) Assignees: Koninklijke Philips Electronics N.V., Eindhoven (NL)

SAES Getters, S.p.A., Lainate (IT)

Signed and Sealed this

Twenty-sixth Day of February, 2008

JON W. DUDAS
*Director of the United States Patent and Trademark Office*